US005385585A

United States Patent [19]

Kiesewetter et al.

[11] Patent Number: 5,385,585

[45] Date of Patent: Jan. 31, 1995

[54] USE OF ANIONIC ALKYL CELLULOSE MIXED ETHERS IN TEXTILE PRINTING

[75] Inventors: René Kiesewetter, Soltau-Ahlften; Eugen Reinhardt, Walsrode; Reinhard Kniewske, Fallingbostel; Klaus Szablikowski, Walsrode, all of Germany

[73] Assignee: Wolff Walsrode AG, Walsrode, Germany

[21] Appl. No.: 9,532

[22] Filed: Jan. 27, 1993

[30] Foreign Application Priority Data

Feb. 7, 1992 [DE] Germany ..... 4203531

[51] Int. Cl.[6] ..... C09B 67/00; D06P 1/50

[52] U.S. Cl. ..... 8/562; 106/197.2; 8/528

[58] Field of Search ..... 8/528, 559, 562; 106/197.2

[56] References Cited

U.S. PATENT DOCUMENTS 2,628,151 2/1953 Walmsley et al. ..... 8/559
3,771,955 11/1973 Jones ..... 8/562
4,027,345 6/1977 Fujisawa et al. ..... 8/468
4,082,506 4/1978 Koenig et al. ..... 8/562
4,192,647 3/1980 Kuryla et al. ..... 8/562

OTHER PUBLICATIONS

M. Peter & H. K. Rouette "Grundlagen der Textilveredlung" Dec. 1989, pp. 620–623.

Database WPI, Week 6450, Derwent Publications Ltd., London, GB; AN 74–86713V & SU–A–413 238 (Paper Res. Inst.), Jul. 1, 1974.

*Primary Examiner*—Paul Lieberman
*Assistant Examiner*—Margaret Einsmann
*Attorney, Agent, or Firm*—Sprung Horn Kramer & Woods

[57] ABSTRACT

The present invention relates to the use of anionic alkyl cellulose mixed ethers, preferably alkyl carboxy-methyl cellulose mixed ethers and, more preferably methyl carboxymethyl cellulose mixed ethers (MCMC), as auxiliaries in the textile industry and preferably as thickeners for textile printing pastes.

5 Claims, No Drawings

USE OF ANIONIC ALKYL CELLULOSE MIXED ETHERS IN TEXTILE PRINTING

The present invention relates to the use of anionic alkyl cellulose mixed ethers, preferably alkyl carboxymethyl cellulose mixed ethers and, more preferably, methyl carboxymethyl cellulose mixed ethers (MCMC), as auxiliaries in the textile industry and preferably as thickeners for textile printing pastes.

The composition of textile printing pastes—irrespective of the particular dye used—is determined by the method of printing, the substrate, the method of fixing and the method of application. In addition to dyes, all printing pastes contain thickeners. The function of the thickeners is to give the dye-containing aqueous liquor a pumpable and printable consistency. On the one hand, it should be fluid and, on the other hand, so immovable that it keeps the dye firmly in the position required by the pattern and hence provides for sharp contours. In addition, the thickener acts as a protective colloid and protective film in the printing paste. By regulating the moisture balance, it has a lasting effect on the dye yield (B. Habereder, F. Baierlein in: Handbuch der Textilhilfsmittel; Editor: A. Chwala, V. Anger, Verlag Chemie, Weinheim, 1977, page 621). This results in a number of requirements which thickeners and the pastes thickened with them are expected to satisfy:

Thickeners and the pastes thickened with them should be stable in storage without the addition of preservatives which is undesirable for health and economic reasons. In addition, the thickened pastes must be compatible with the corresponding dyes and should not react with them.

Reactive dyes, for example, contain reactive groups which, under dyeing conditions, react with the substrate in the presence of alkalis and fix the dye by covalent bonding (H. Zollinger, Angew. Chem. 73, 125 (1961). Thickeners which are similar in structure to the substrate to be dyed are normally unsuitable because the are capable of reacting with the reactive dyes.

Accordingly, the use of cellulose starch and carob bean flour derivatives, gum arabic, tragacanth and the like generally leads to hardening of feel, poor dye yields and, in some cases, unsatisfactory fastness values.

In order to avoid defective printing which could be caused by blockage of the stencils, gauze or rotary stencils, the thickened pastes have to be completely free from fibers and gel particles. To avoid poor printing quality, hardening of the printed areas and time-consuming and expensive aftertreatment processes, thickeners have to be readily removable by washing. Finally, thickeners should be available in standardized form and should be as inexpensive as possible because they do not provide the textile material with better properties, but instead are washed out again.

Most of the thickeners used in the printing of textiles are alginates (Ciba-Rundschau, No. 1, 19–34 (1969)) which are generally used in concentrations of 3 to 4%. The alkali metal salts of alginic acids have the advantage that they can be easily removed by washing. Alginates are compatible with a number of dyes and are largely stable at pH values in the range from 5 to 10. At higher pH values, trans-eliminative depolymerizations are observed (A. Hang et al., Acta Chem. Scand. 21, 2859 (1967)). Alkali metal alginates are incompatible with heavy metal salts, calcium and aluminium compounds, so that complexing agents have to be used. As a biopolymer, alginates are readily degraded by microorganisms. Unprotected thickened pastes generally keep for only 1 to 10 days so that preservatives, preferably formaldehyde solutions or phenols, have to be added although their use is extremely questionable on account of the serious potential dangers involved.

The use of thickened pastes for textile printing in relatively hot climates presupposes high temperature stability on the part of the thickeners used. Where alginates are used, quantitative decarboxylations can occur. In addition, the process for producing alginates obtained from seatang has become more labor-intensive and expensive in recent years, as reflected in high, distinctly increased prices, so that there is a need for inexpensive replacements.

Among the thickeners used in the printing of textiles, xanthans, emulsion thickeners and synthetic polymer thickeners are of importance, although they are all attended by a number of disadvantages so that the desired effects cannot all be achieved with a single thickener. For example, printing with emulsion thickeners is highly retrogressive on price and ecological grounds. Apart from their high costs, xanthans are not sufficiently stable to microbial degradation. Polymeric thickeners are extremely sensitive to electrolytes so that they are vulnerable to the effects of hard water, anionic dyes and diluent salts.

There has been no shortage of attempts in recent years to use polysaccharides, more particularly sodium carboxymethyl celluloses (Na-CMC) either on their own or in the form of compounds, as thickeners in the printing of textiles (EP-A 0 106 228, DD 158 403). Commercially available sodium carboxymethyl celluloses generally have degrees of substitution (DS values) of only 0.3 to 1.4 (G.I. Stelzer, E.D. Klug in: Handbook of Water Soluble Gums and Resins, Editor: R. L. Davidson, McGraw Hill, New York 1980, page 4-1). In view of the low degree of substitution, their use as thickeners leads to reactions with the reactive dye, resulting in poor dye yields and hardening of feel. In addition, the reactive dyes thus inactivated are frequently incorporated in the substrate (P. Bajaj et al. in: J. Macromol. Sci., Rev. Macromol. Chem. 1984, C 24 (3), 378 et seq.). These non-covalently bonded dyes have to be removed by intensive washing in order to obtain good wet fastness values. Accordingly, to prevent a possible reaction between the thickener and the reactive dye, specialities having degrees of substitution (DS) of 2.0 or higher are used (DE 3 208 430, JA 5 9192-786).

Carboxymethyl celluloses are soluble in cold and hot water which affords significant advantages in conjunction with their ready removability by washing. The simple adjustment of viscosity provides for good printing, even at relatively high machine speeds (H. B. Bush, H. B. Trost, Hercules Chem., Vol. 60, 14 (1970)). However, commercially available carboxymethyl cellulose solutions are readily degraded by microorganisms. In addition, their poor salt stability, particularly with respect to polyvalent cations (calcium ions), and their ability to react with the dyes (reactive dyes) are significant disadvantages. Accordingly, attempts have been made to increase stability to electrolytes and bacteria and to improve compatibility with dyes by modifying the alkalization (EP 0 055 820), by mixed etherification (SU 794 098, EP-A 0 319 865) and by increasing the degree of substitution (DE-OS 3 303 153, U.S. Pat No. 4,426,518).

The products etherified almost completely by a multi-step process lead to a distinctly improved property profile of the carboxymethyl cellulose (CMC). However, highly substituted products such as these necessitate multiple repetition of the alkalization and etherification step, resulting—over all stages—in very poor substitution yields so that complex and expensive production processes have to be used (K. Engelskirchen in Houben-Weyl "Makro-molekulare Stoffe", Vol. E 20/III, Georg Thieme Verlag, Stuttgart, 1987, pages 2072 to 2076). Although mixed etherification leads to an improvement in stability to electrolytes, coagulation cannot be definitely ruled out (W. Hansi in: Dtsch. Farben Ztschr. 25, 1971, pages 493 et seq.).

Accordingly, the problem addressed by the present invention was to provide cellulose mixed ethers as thickeners, dispersants or binders for the textile industry which would have excellent qualities, i.e. very good solubility properties, and none of the disadvantages of the thickeners presently used in the printing of textiles.

It has now surprisingly been found that alkyl carboxymethyl cellulose mixed ether, more particularly methyl carboxymethyl cellulose mixed ether, does not have the sensitivity to salts, particularly polyvalent cations, typical of carboxymethyl cellulose.

The anionic alkyl cellulose mixed ethers suitable for use in the printing of textiles in accordance with the present invention, preferably alkyl carboxymethyl cellulose mixed ether and, more preferably, methyl carboxymethyl cellulose mixed ether have degrees of substitution DS in regard to carboxymethyl of 0.01 to 1.9 and, more particularly, 0.1 to 1.6 and have an average total degree of substitution DS of 1.3–2.2 and, more particularly, 1.5–2.0. The teaching for the production of these compounds can be found, for example, in the following patents: U.S. Pat. No. 2,476,331, GB 659,506, U.S. Pat. No. 2,510,153, SU 384 828, DE-OS 3 303 153, DD 140 049 or I. M. Timokhin et al., Izv. Vyssh., Ucheb. Zaved. Neft. Gas, 16 (11), 31-5 (1973).

The gel- and fiber-free cellulose derivatives characterized by the test described hereinafter are distinguished by excellent solution quality and may be used as thickeners, dispersants or binders in the textile industry, more particularly in the printing of textiles. They have the following advantages over the thickeners presently used in the textile industry, more particularly in the printing of textiles:

1. Excellent electrolyte stability, more particularly with respect to polyvalent cations, especially calcium ions, through mixed etherification.
2. Very good acid, alkali and temperature stability.
3. Very good stability to microbial degradation and excellent compatibility with dyes and chemicals as a result of the high total degree of substitution of the cellulose ether.
4. Good dye fixing and substantially complete release of the dye to substrate.
5. Improved printing properties, such as levelness and sharpness through gel- and fiber-free solution qual ity.
6. Problem-free production of the cellulose ethers on an industrial scale as well as consistent quality compared with alginates.
7. Simple technology for the production of cellulose derivatives in powder or granule form.

The anionic alkyl cellulose mixed ethers according to the invention have excellent qualities and, both as purified and as unpurified (technical) products, dissolve in water to form solutions free from gel particles and fibers. The products have average total degrees of substitution of 1.3 to 2.2 and, more particularly, 1.5–2.0.

The cellulose mixed ethers used have viscosities of 5 to 80,000 mPa.s and, more particularly, in the range from 100 to 30,000 mPa.s (as measured in 2% by weight aqueous solution at a shear rate of D of 2.5 sec.$^{-1}$/20° C.) and have transmission values of more than 95% and, in particular, more than 96% (as measured on a 2% by weight aqueous solution in a cell at an optical path length of 10 mm with light having a wavelength A of λ of 550 nm).

The alkyl cellulose mixed ethers according to the invention are distinguished by very good solubility in water. The products have a small insoluble component, determined by centrifugation (20 mins. at 2,500 G), of less than 1% and, more particularly, less than 0.5%.

The anionic cellulose mixed ethers produced by one of the processes mentioned above are preferably used as thickeners in textile printing pastes.

The substrates used include, for example, cellulose or regenerated cellulose, polyester, wool, silk, nylon, polyamides or blended fabrics. The substrate may consist of any material which can be printed with the corresponding dyes.

The printing paste may be applied by any printing and dyeing processes, for example by manual application, block printing, letterpress printing, jet printing, stencil printing, planographic or rotary film printing or similar conventional printing or dyeing processes.

The printed dyes are fixed with the aid of heat after application of the printing paste to the substrate. The substrate is then washed, dried and optionally subjected to further treatments.

In the following Examples, the effect of a methyl carboxymethyl cellulose (MCMC) used in accordance with the invention as a thickener in a textile printing paste is compared with a commercially available sodium alginate (Lamitex® M 5, a product of Protan, Norway). The sodium alginate was in the form of a 6% solution and the MCMC in the form of a 3.4% solution.. Various cotton qualities were printed by laboratory printer (Zimmer planographic film printing) with various inks and under various fixing conditions.

To avoid defective printing which could be caused by blockage of the stencils, gauze or rotary stencils, the methyl carboxymethyl cellulose (MCMC) used in accordance with the invention is tested by the above-described method for its transmission and its water-soluble component before being performance-tested in the printing of textiles. The characteristic data of the MCMC used are shown in Table 1.

TABLE 1

Characteristic data of the MCMC[1] used

| Type | $DS_{CM}$[2] | $DS_{ME}$[2] | Viscosity[3] (mPa · s) | Transmission[4] (%) | Water-insoluble component (%) |
|---|---|---|---|---|---|
| MCMC | 0.97 | 0.96 | 1.221 | 95.7 | 0.04 |

[1]Methyl carboxymethyl cellulose as a technical, nonpurified product based on a linters cellulose having an average DP of 2000, as determined by the Zellcheming method, Merkblatt IV/50/69

[2]$DS_{CM}$ = Average degree of substitution by carboxymethyl groups (ASTM-D 1439/83a/method B)

$DS_{ME}$ = Average degree of substitution by methyl groups (ASTM-D 3876/79)

see: K. Balser, M. Iseringhausen in Ullmanns Encyclopädie der technischen Chemie, 4th Edition, Vol. 9, Verlag Chemie, Weinheim, 1983, pages 192–212

TABLE 1-continued

[3]Viscosity, 2% by weight aqueous solution, rotational viscosimeter (Haake), Type RV 100, System M 500, measuring unit MV, according to DIN 53 019, at a shear rate D of 2.5 $s^{-1}$ (T = 20° C.)
[4]Hitachi spectral photometer, model 101, Hitachi Ltd. Tokyo/Japan; glass cell with an optical path length of 10 mm (λ = 550 nm; 2% by weight solution in distilled water.)
Average of three gravimetric determinations.

The thickening mixture was tested for its pseudoplastic behavior by comparison with Lamitex M 5 (Table 2)

TABLE 2

Thickening mixtures/pseudoplasticity (Permutit water)

| Product | Concentration (%) | pH value | Viscosity (Brookfield RVT, spindle 6) [mPas] 2.5 (r.p.m.) | 20 (r.p.m.) | 100 (r.p.m.) |
|---|---|---|---|---|---|
| Lamitex M 5[1] | 4.7 | 6.5 | 12,000 | 10,000 | 6,690 |
| MCMC | 3.4 | 9.0 | 14,800 | 10,300 | 5,370 |

[1]The Lamitex M 5 mixture contains an addition of 5 g/kg Calgon T and 5 kg/g formalin (37%)

The effect of calcium ions was determined by addition of a 73.9% by weight calcium chloride solution to 200 g of a 1% by weight solution of the particular thickening composition. Lamitex M 5 and carboxymethyl cellulose (CMC) coagulate when only small quantities of calcium chloride solution are added. Despite the high degree of substitution by carboxymethyl groups, the MCMC is surprisingly stable to calcium ions (Table 3).

TABLE 3

MCMC alginate-CMC; effect of $CaCl_2$

| Addition of $CaCl_2$ solution[1] [ml] | Electrolyte stability of Alginate[2] | CMC[3] | MCMC[4] |
|---|---|---|---|
| 0.1 | Coagulation | Stable | Stable |
| 0.5 | Coagulation | Stable | Stable |
| 1.0 | Coagulation | Stable | Stable |
| 1.65 | Coagulation | Coagulation | Stable |
| 2.0 | Coagulation | Coagulation | Stable |
| 4.0 | Coagulation | Coagulation | Stable |

[1]73.9% by weight $CaCl_2$ solution. Addition to 200 g of a 1% by weight solution of the thickening composition
[2]Lamitex M5
[3]CMC, DS carboxymethyl = 1.5; viscosity of a 2% by weight aqueous solution 470 [mPa · s]; (D = 2.5 $s^{-1}$, 20° C.
[4]MCMC 1 (see Table 1)

The effect of NaCl and of changes in pH on the viscosity of MCMC is illustrated in Tables 4 and 5 below.

TABLE 4

MCMC-alginate-CMC: effect of NaCl

| Addition of NaCl per kg | Change in viscosity MCMC (3.4%) (%) | Alginate[1] (4.7%) (%) |
|---|---|---|
| +1 g/kg | −1.7 | +6.4 |
| +5 g/kg | ±0 | +6.4 |
| +10 g/kg | ±0 | +6.4 |

[1]Lamitex M 5

TABLE 5

MCMC-alginate; effect of changes in pH

| pH changed with | Change in pH from pH 9 (MCMC) or pH 6.5 (alginate) to | Change in viscosity MCMC (3.4%) (%) | Alginate (4.7%) (%) |
|---|---|---|---|
| Tartaric acid | 6 | −6 | +2 |
| Taratric acid | 5 | −6 | +6 |
| Tartaric acid | 4 | −9 | +7 |
| Taratric acid | 3 | −6 | +95 |
| NaOH | 10 | −2.4 | −7 |
| NaOH | 11 | −2.4 | −10 |
| NaOH | 12 | −2.4 | −10 |

The stability of the thickeners MCMC and alginate in storage at 20° C. and 40° C. was tested by corresponding viscosity measurements. The results are set out in Table 6.

TABLE 6

Stability in storage of alginate and MCMC

| Measurement | Viscosities (mPa · s) MCMC[1] 20° C. | MCMC[1] 40° C. | Alginate[2] 20° C. | Alginate[2] 40° C. |
|---|---|---|---|---|
| Immediately | 10,941 | 10,941 | 10,929 | 10,929 |
| After 1 week | 10,643 | 9,926 | 12,183 | 6,343 |
| After 2 weeks | 10,320 | 8,122 | 10,284 | 5,626 |
| After 4 weeks | 9,854 | 5,303 | 3,261 | 3,583 |
| After 8 weeks | 9,245 | 2,616 | 108 | Sediment; no measurable solution |

[1]3% by weight aqueous solution (rotational viscosimeter D = 2.5 $s^{-1}$, 20° C.)
[2]4.2% by weight aqueous solution (rotational viscosimeter D = 2.55 $s^{-1}$, 20° C.)

The composition of the stock thickening formulations produced with Lamitex M 5 and MCMC is shown in Table 7, the composition of the printing pastes being shown in Table 8.

TABLE 7

Composition of the stock thickening formulations

| Thickening constituents | Stock thickening formulations[1] A | B | C | D |
|---|---|---|---|---|
| Lamitex M 5 ® (6%) | 580 | — | — | — |
| MCMC (3.4%) | — | 600 | 675 | 750 |
| Lyoprint ® RG | 11 | 11 | 11 | 11 |
| Urea | 110 | 110 | 110 | 110 |
| $Na_2CO_3$, calc. sol., 1:4 | 85 | 85 | 85 | 85 |
| Permutit.- water | 211 | 191 | 116 | 41 |
| Lyoprint AP ® | 3 | 3 | 3 | 3 |
| pH Value | 10.9 | 10.9 | 10.9 | 10.9 |
| Viscosity[2] | 5800 | 3000 | 4500 | 7100 |

[1]Quantities in parts by weight
[2]Brookfield RVT, spindel 6, 20 r.p.m.

TABLE 8

Printing pastes

| Composition of printing paste | pH | Viscosity[1] (mPa · s) |
|---|---|---|
| 1. 90 Parts stock A + 10 parts Cibacron Blau 3 R flüssig (40%) | 10.9 | 4,100 |
| 2. 90 Parts stock B + 10 parts Cibracon Blau 3 R flüssig (40%) | 10.9 | 2,200 |
| 3. 90 Parts stock C + 10 parts Cibacron Blau 3 R flüssig (40%) | 10.9 | 3,500 |
| 2. 90 Parts stock D + 10 parts Cibacron Blau 3 R flüssig (40%) | 10.9 | 5.200 |

(Parts = parts by weight)
[1]Viscosity: Brookfield RVT, Spindel 6, 20 r.p.m.

Various substrates were printed with the printing pastes shown in Table 8. Since the binding of dye to cellulose and the production of deep, brilliant and clear prints is promoted by well prepared material, the various substrates were pretreated in different ways. A 64 T stencil (rectangle) and an 8 mm diameter doctor blade (magnet stage 6, speed stage 3 or 10) were used to evaluate strength, color tone, penetration, feel and levelness. A 68 T stencil and a 6 mm diameter doctor blade (magnet stage 6, speed stage 3) were used to evaluate sharpness. Cotton/filling satin (mercerized, bleached) and cotton/renforcé (bleached) were used as the substrates. The textile material was dried for approx. 5 mins. at 90° C. In the fixing step with saturated steam (100° to 102° C.), the steaming time was approx. 8 mins. (interval, Mathis). In addition, the cotton/filling satin substrate was fixed by dry heat (hot air) for approx. 1 min. at 200° C. (Mathis). Washing out was carried out in three stages:

a) thorough cold rinsing, b) treatment in the vicinity of the boiling temperature (10 mins.), c) cold rinsing The results of the various printing tests are shown in Tables 9 to 11.

TABLE 9

Printing results
Cotton, mercerized, bleached, saturated steamfixing, comparison with Lamitex M 5 (= No. 1)

| Print or printing paste | Strength[1)] | Color tone[1)] | Penetration | Levelness | Sharpness |
|---|---|---|---|---|---|
| 1. | 100%[2)] | —[2)] | —[2)] | —[2)] | —[2)] |
| 2. | 96% | Almost the same | Distinctly more | Almost the same | Distinctly better |
| 3. | 94% | Trace purer | Slightly more | Almost the same | Distinctly better |
| 4. | 87% | Trace greener | Some - distinctly less | Almost the same | Distinctly better |

[1)]Colorimetry measurement
[2)]Comparison

TABLE 10

Printing results
Cotton, mercerized, bleached, hot air fixing, comparison with Lamitex M 5 (= No. 1)

| Print or printing paste | Strength | Color tone[1)] | Penetration | Levelness |
|---|---|---|---|---|
| 1. | 100%[2)] | —[2)] | —[2)] | —[2)] |
| 2. | 112% | Slightly - distinctly redder, distinctly purer | Distinctly more | Slightly better |
| 3. | 102% | Slightly - distinctly redder, Distinctly purer | Slightly more | Slightly better |
| 4. | 101% | Slightly - distinctly redder, Distinctly purer | Slightly more | Slightly better |

[1)]Colorimetry measurement
[2)]Comparison

TABLE 11

Printing results
Cotton, bleached, saturated steam fixing, comparison with Lamitex M 5 (= No. 1)

| Print or printing paste | Strength[1)] | Color tone[1)] | Penetration | Levelness | Feel |
|---|---|---|---|---|---|
| 1. | 100%[2)] | —[2)] | —[2)] | —[2)] | —[2)] |
| 2. | 91% | Almost the same | Slightly more | Slightly better | Almost the same |
| 3. | 88% | Almost the | Almost the | Slightly better | Almost the |

TABLE 11-continued

Printing results
Cotton, bleached, saturated steam fixing, comparison with Lamitex M 5 (= No. 1)

| Print or printing paste | Strength[1)] | Color tone[1)] | Penetration | Levelness | Feel |
|---|---|---|---|---|---|
| | | same | same | | same |
| 4. | 87% | Trace redder, Slightly purer | Slightly less | Slightly better | Almost the same |

[1)]Colorimetry measurement
[2)]Comparison

The values set out in the following Table illustrate the superiority of the MCMC used in accordance with the invention in the printing of textiles.

The expressions used in the Tables are familiar to the expert on cellulose and textile printing and require no further explanation. Relevent information can be found in the chapters entitled "Textildruck" and "Textilfärberei" in Ullmanns Encyclopädie der technischen Chemie, Vol. 22, pages 565 et seq. and 635 et seq. (Verlag Chemie, Weinheim, 1982) .

TABLE 12

Exemplary comparison between a conventional thickener used in textile printing, sodium alginate (Lamitex M 5, a product of Protan, Norway), and as claimed according to the invention methyl carboxymethyl cellulose (MCMC)

| | Alginate | MCMC[1)] |
|---|---|---|
| 1. Preservation | Absolutely essential | Not necessary |
| 2. Rheology | Good | Good |
| 3. Stability in storage of thickened paste | Poor despite formaldehyde | Excellent |
| 4. Stability in storage of stock thickening composition | Poor despite formaldehyde | Excellent |
| 5. Stability in storage of printing paste | Poor despite formaldehyde | Excellent |
| 6. Color tone stability | Poor despite formaldehyde | Excellent |
| 7. pH Stability | Good | Good |
| 8. NaCl stability | Good | Good |
| 9. Calcium stability | Very poor, Calgon T necessary | Excellent, no Calgon T necessary |
| 10. Resistance to alkalis | Adequate | Good |
| 11. Resistance to acids | Adequate | Good |

TABLE 12-continued

| Exemplary comparison between a conventional thickener used in textile printing, sodium alginate (Lamitex M 5, a product of Protan, Norway), and as claimed according to the invention methyl carboxymethyl cellulose (MCMC) | | |
|---|---|---|
| | Alginate | MCMC[1)] |
| 12. Shear stability | Good | Good |

[1)]degree of substitution by carboxymethyl groups: 0.97; degree of substitution by methyl groups: 0.96

We claim:

1. In a the method of printing of a textile with a flowable printing paste in which said paste is applied to said textile, the improvement comprises including in the paste methyl carboxymethyl cellulose as a thickener and flow promoter.

2. The method according to claim 1, wherein the methyl carboxymethyl cellulose has a transmission value of more than 95% (as measured on a 2% by weight aqueous solution in a cell having an optical path length of 10 mm with light having a wavelength λ of 550 nm) and a water-soluble component of >99%.

3. The method according to claim 1 wherein the textile comprises a fiber blend, natural fibers or regenerated cellulose.

4. The method according to claim 1, wherein the printing paste includes an oxidation dye, sulfur dye, anionic dye, development dye, wool chrome dye, substantive dye or reactive dye.

5. The method according to claim 1, wherein the methyl carboxymethyl cellulose has a transmission value of more than 96% (as measured on a 2% by weight aqueous solution in a cell having an optical path length of 10 mm with light having a wavelength λ of 550 nm) and a water-soluble component of >99.5%, the textile comprises a fiber blend, natural fibers or regenerated cellulose, and the printing paste includes a reactive dye.

* * * * *